United States Patent [19]

Gauger

[11] 4,404,773

[45] Sep. 20, 1983

[54] TOOL GRINDING FIXTURE

[76] Inventor: Richard L. Gauger, 1N050 Coolidge Ave., West Chicago, Ill. 60185

[21] Appl. No.: 259,840

[22] Filed: May 4, 1981

[51] Int. Cl.[3] ..... B24B 3/34

[52] U.S. Cl. ..... 51/218 A

[58] Field of Search ..... 51/218 A, 218 R, 217 A, 51/220

[56] References Cited

U.S. PATENT DOCUMENTS

| | | | |
|---|---|---|---|
| 1,783,540 | 12/1930 | Hogg | 51/220 |
| 2,432,058 | 12/1947 | Wilken | 51/220 |
| 2,887,833 | 5/1959 | Passarotti | 51/218 R |
| 3,020,681 | 2/1962 | Hite | 51/218 A |
| 3,680,268 | 8/1972 | Lorton | 51/218 A |

*Primary Examiner*—Harold D. Whitehead

*Attorney, Agent, or Firm*—Edmond T. Patnaude

[57] ABSTRACT

There is described a tool grinding fixture for use on a standard grinder for grinding lathe tool bits, drill bits, face grinding end mills and radius dressing grinding wheels.

9 Claims, 7 Drawing Figures

TOOL GRINDING FIXTURE

The present invention relates in general to fixtures for holding tool bits during grinding operations on the bits, and it relates in particular to a fixture having new and improved means for mounting a tool bit at an angularly adjustable position relative to a magnetic chuck on which the fixture may be mounted.

BACKGROUND OF THE INVENTION

There is a need for relatively inexpensive means for enabling small manufacturing facilities to sharpen various types of tool bits rather than discarding the dull bits or sending them out for sharpening. Inasmuch as surface grinders having magnetic chucks are standard equipment and commonly used in machine shop facilities, it would be desirable to provide a fixture adapted for use with surface grinders for enabling the facile grinding and sharpening of various tool bits on surface grinders. Preferably, such a fixture should be usable with lathe bits and milling bits as well as with other tool bits such as drill bits and it should be suitable for radius dressing grinding wheels.

SUMMARY OF THE INVENTION

Briefly, in accordance with the present invention there is provided a grinding fixture having a base plate formed of a ferromagnetic material for attachment to a magnetic chuck, a pivot plate pivotally attached to the base plate, a tool post slidably mounted to the pivot plate, and a tool holder comprising a first L-shaped member pivotably mounted to the tool post for angular adjustment about an axis lying perpendicular to the pivot axis of the pivot plate and a second member in the form of a lathe tool bit holding block mounted to the L-shaped member for pivoted movement about an axis at right angles to both the pivot axis of the L-shaped member and the pivot axis of the pivot plate.

In accordance with another aspect of the invention the tool holder may be replaced with an end mill holding block adapted to receive an end mill bit. The end mill holding block is pivotably mounted to the tool post for angular adjustment on both sides of the vertical to establish rake.

When used for grinding drill bits, a drill bit holding block is attached to the toll post for angular adjustment relative to the post and to the associated grinding wheel. Similarly, a grinding wheel dresser may be attached to the tool post.

GENERAL DESCRIPTION OF THE DRAWING

The present invention will be better understood by a reading of the following detailed description taken in connection with the accompanying drawing wherein.

DETAILED DESCRIPTION OF THE INVENTION

Figure 1:
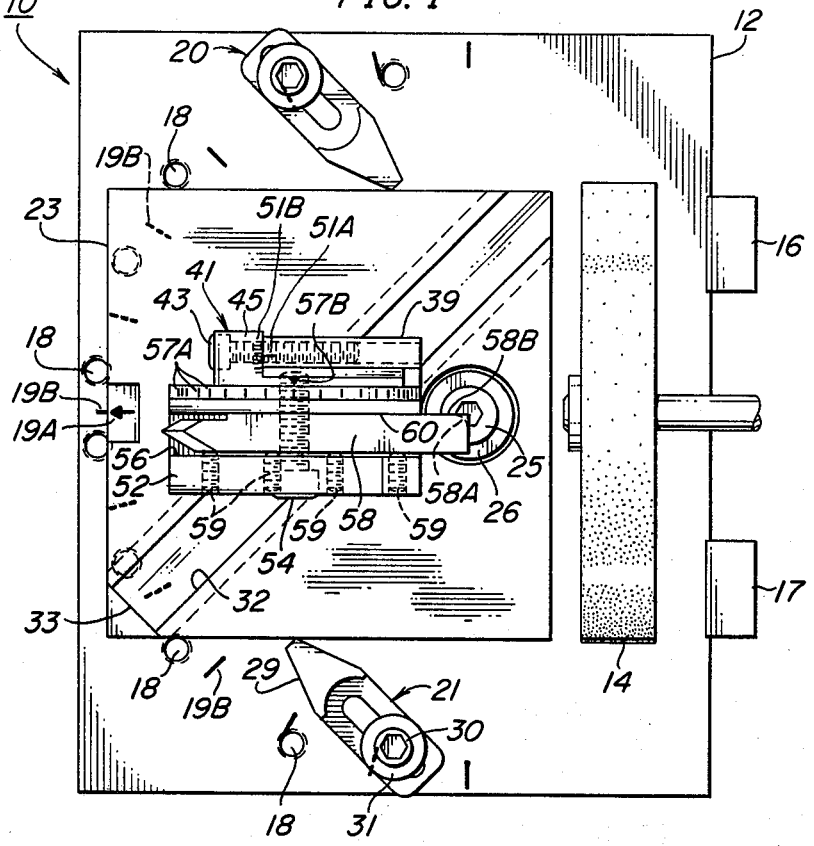
FIG. 1 is a plan view of a fixture embodying the present invention, the illustrated fixture being used for grinding a lathe tool bit.
Figure 2:
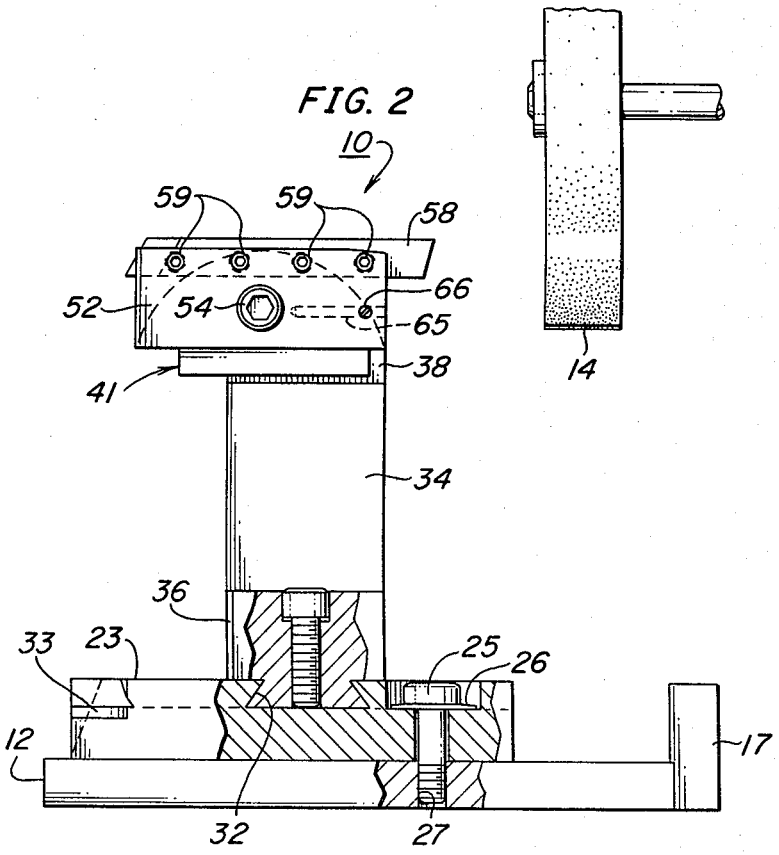
FIG. 2 is a fragmentary elevational view, partially sectioned, taken from the bottom of FIG. 1.
Figure 3:
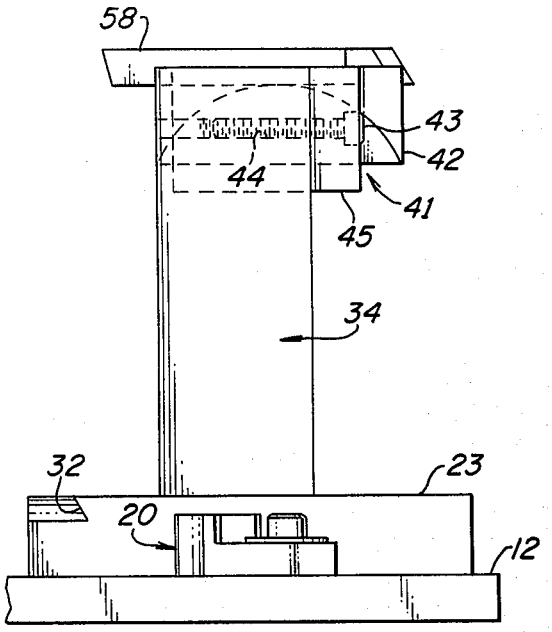
FIG. 3 is a fragmentary elevational view taken from the top of FIG. 1.

Referring particularly to FIGS. 1 through 4, a tool bit grinding fixture 10 may be seen to comprise a rectangular base plate 12 formed of a ferromagnetic material such as steel for mounting on the magnetic chuck of a surface grinder (not shown). In FIGS. 1 and 2 the grinding wheel 14 of the surface grinder is shown. A pair of solid stop members 16 and 17 are mounted in fixed positions to the back edge of the base plate 12. A circle of tapped bolt holes 18 are provided in the plate 12 for receiving a pair of selectively positionable stops 20 and 21 which, as described more fully hereinafter, are used to lock a square pivot plate 23 in an adjustable position on the base plate 12. The pivot plate 23 is pivotably mounted to the base plate 12 by means of a pivot pin in the form of a shoulder bolt 25 threadedly received in tapped hole 27 on the center line of the base plate 12. A spring washer 26 prevents spurious loosening of the pin 25. A reference mark 19A is provided on the pivot plate 23 and a plurality of angularly spaced graduation lines 19B are provided on the base plate 12 for convenience in setting the pivot plate at the desired angle.

The stops 20 and 21 each include a lock slide 29 having a longitudinal slot through which a bolt 30 extends into a selected one of the bolt holes 18. A washer 31 is positioned between the head of the bolt 30 and the upper surface of the lock slide member 29 to facilitate tightening of the bolt.

The pivot plate 23 is provided with a dovetail slot 32 extending diagonally from one front corner of the plate 23 to the opposite rear corner as shown in FIG. 1. The pivot plate is cut away at 33 at the front corner beneath the slot 32 to facilitate making a measurement with a depth micrometer of the position of a tool post 34 mounted in the slot 32. The tool post 34 has a square base and it also has the front corner cut away to provide a flat vertical surface 36 parallel to surface 33 (shown in FIG. 2) to facilitate making the said micrometer measurement.

Figure 4:
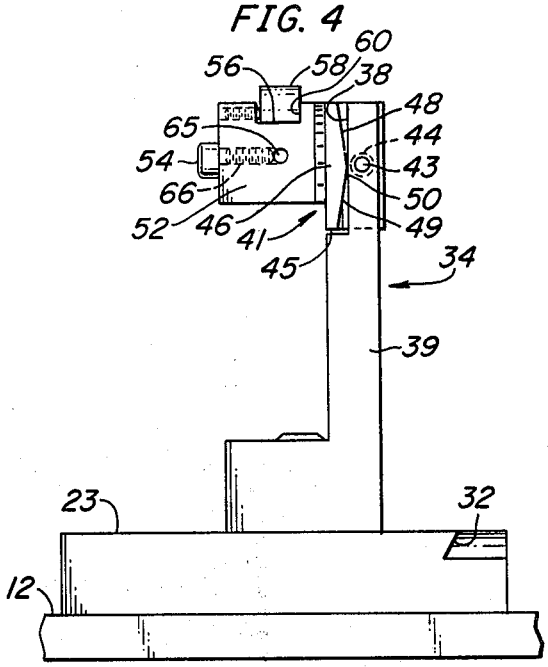
FIG. 4 is a fragmentary elevational view of the rear of the fixture as seen from the right hand side of FIG. 1.

As best shown in FIG. 4, the tool post 34 is generally L-shaped and a rectangular notch 38 is provided in the side of the upright leg 39. A tool holder assembly 41 is mounted to the upper portion of the tool post leg 39 by a pivot pin 43 threadedly received in a hole 44 in the leg 39 to permit pivotal adjustment of the tool holder assembly about a horizontal axis. The pin 43 rotatably extends through a hole in an L-shaped pivot member 45. In order to hold the tool holder assembly in a pre-set angularly adjusted position the leg portion 46 of the pivot member 45 lies alongside the post leg 39 in the notch 38 and its surfaces 48 and 49 slope away from a central pivot line 50. Consequently, the holder assembly 41 can be pivoted to either side of the vertical about the axis of the pin 43. A reference mark 51A is provided on the top surface of the post 34 for use with a plurality of graduation lines 51B on the upper surface of the member 45 to indicate the angular position of the member 45 relative to the vertical.

In addition to the L-shaped part, the tool holder assembly 41 includes a solid block 52 which is mounted to the leg portion 46 by a pivot screw 54 which permits angular adjustment of the block 52 from the front to rear about a horizontal axis. A groove 56 is provided in the upper surface of the block 52 and extends from front to rear to receive a lathe tool bit 58 or the like. The tool bit 58 is slidable along the groove 56, and a plurality of set screws 59 extend through tapped holes in the side of the block 52 to lock the bit in the desired position against the side 60 of the groove 56.

The portion of the block 52 disposed adjacent the member 45 is convex and provided with a plurality of graduation lines 57A which when used with a reference mark 57B on the top of the member 45 facilitate setting of the desired angular position of the tool block.

Figure 5:
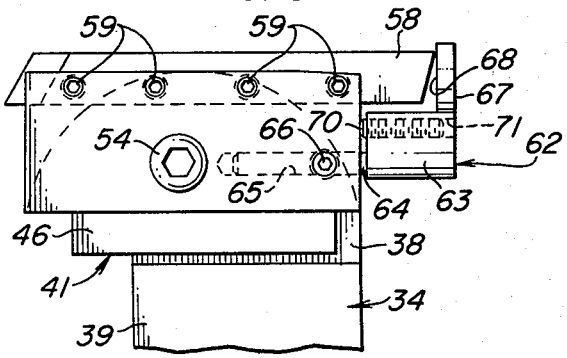
FIG. 5 is an elevational view illustrating the use of a positioning tool useful in adjusting the position of a lathe tool bit in the tool holding block.
Figure 6:
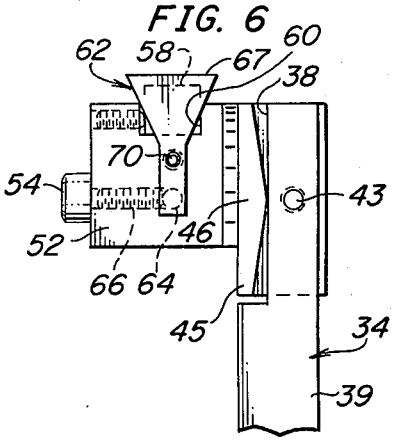
FIG. 6 is a view taken from the right hand side of FIG. 5.

In order to set the cutting edge of the tool bit at the proper position for grinding when it is necessary and pertains to the accuracy of grinding as, for example, in radius grinding, that position being directly over the pivot axis of the pivot plate 23, a gauge block 62 is provided. As best shown in FIGS. 5 and 6, the gauge block 62 includes a body portion 63 having a guide pin 64 extending therefrom for slidable reception in a guide hole 65 in the tool holder block 56 to permit movement of the gauge block in a direction parallel to the longitudinal axis of the tool bit. A set screw 66 is provided to lock the pin 64 at the set position in the block 52. The gauge block further includes an upright portion 67 having a tool bit engaging surface 68. A set screw 70 is threaded into a tapped hole 71 in the body 63 to adjustably preset the position of the tool bit engaging surface 68 for precisely locating the lathe tool bit relative to the pivot point of the pivot plate.

In order to use the fixture 10 in the sharpening of a lathe tool bit 53 to provide an outside radius as shown at 58A, the following procedure should be followed:

1. Set all angular adjustments to zero degrees.

2. Set the tool post to the predetermined position by the micrometer reading from the cut 33 to the corner surface 36 of the tool post, and lock the tool post in the slot. This places the side 60 of the tool holder groove 56 on the center line of the pivot point.

3. Rotate the tool holder assembly parts around the axis of their respective pins to establish the desired tool rake. At this time any deviation of the tool bit or the location of the radius on the tool bit relative to surface 60 itself is taken into account and either added to or subracted from the predetermined dimension from cut 33 to the corner of the tool post to place the tool bit in correct relation to the pivot point center line.

4. Insert the gauge block in the tool holder and slide the tool bit in groove 56 to contact the face of the gauge block. Tighten the tool bit in this position and remove the gauge block 62. The front face of the tool bit must be of such an angle that only the top front edge of the tool bit contacts the face of the gauge block. This places the tool bit on the front to rear center line of the pivot point.

5. Advance the tool post in groove 56 by the micrometer reading from the cut 33 to the corner of the tool post the amount of the radius to be ground times 1.4142 and lock the tool post.

To grind the radius either of the following two methods will achieve the same results.

(a) Touch the tool bit to the grinding wheel with the pivot plate set at zero degrees. Set the grinder traverse dial to zero and back the tool bit away from the grinding wheel a greater distance than is to be ground. Remove or reset the adjustable stops for the desired amount of pivoting required. Return to the zero setting on the traverse dial while manually rotating the pivot plate around the pivot point.

(b) Set the pivot plate to 45 degrees and touch the tool bit to the grinding wheel. Grind away the difference between the radius required and the radius required times 1.4142 by rotating the pivot plate manually around the pivot point.

In sharpening and grinding the various shapes and forms of lathe tool bits, on straight or compound planes, the tool bit is placed in the slot of the tool holder with the side to be ground up. The tool bit should extend far enough forward to allow clearance between the tool holder and the grinding wheel. The tool holder assembly and pivot plate are set to whatever angle, angles (compound), necessary to achieve the final form required. The tool bit is angularly repositioned in the slot to grind the surfaces as necessary to achieve the final form.

Figure 7:
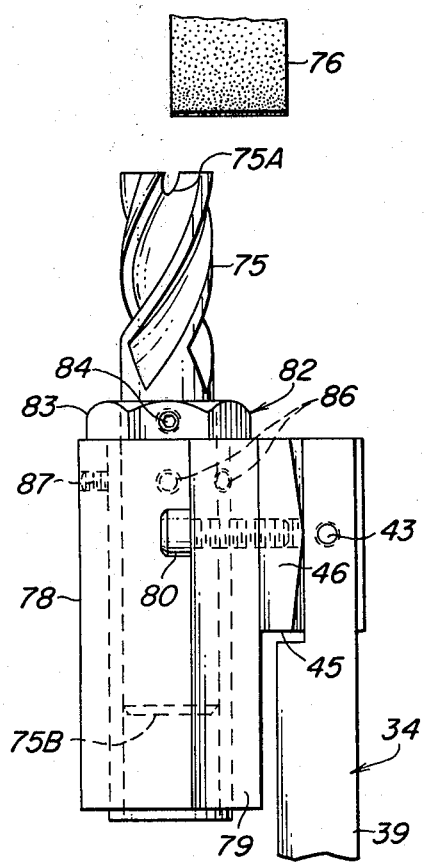
FIG. 7 is an elevational view showing the fixture of the invention set up for grinding an end mill bit.

Referring to FIG. 7, the fixture of the present invention is there shown in use for sharpening an end mill tool bit 75 with a grinding wheel 76. The end mill 75 has a plurality of raked cutting edges 75A at the top and a shank 75B. In this embodiment of the invention the lathe bit holder block is replaced by a mill bit holder block 78 having a forwardly extending flange 79, as shown in FIG. 7, which is pivotably mounted to the leg 46 of the tool holder pivot part 45 by a pivot screw 80. Accordingly, the mill block 78 is pivotable about the two orthogonal horizontal axes of the pivot screws 43 and 80 respectively.

The shank of the end mill is mounted in a shoulder bushing 82 having a hexogonal head 83. The end mill is held in place within the bushing 82 by means of one or more set screws 84. A plurality of blind holes 86 are provided in the bushing 82 and are adapted to receive the end of a set screw 87 threadedly received in a transverse hole in the block 78 for locking the bushing 82 in a selected one of the angular positions predetermined by the locations of the holes 86. The holes 86 thus facilitate indexing and alignment of the flutes with the grinding wheel. If desired, the set screw 87 may be replaced by a cam operated spring pin or the like to facilitate rotation of the mill from one position to another.

If a greater degree of rake is required, the mill holder block 78 can be pivotally mounted directly to the post 34 by the pivot screw 43.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. A grinding fixture for holding a tool bit during a grinding operation in which the tool bit is moved against a rotating grinding wheel, comprising in combination, a base plate adapted to be mounted to the chuck of a grinding machine, a pivot plate resting on said base plate and pivotably connected to said base plate for pivotal movement about a vertical axis, said pivot plate having a rectilinear guideway in its upper face, the longitudinal axis of said guideway being displaced from said vertical axis, an upstanding tool post mounted on said pivot plate and having a guide surface complimentary to and mating with said guideway for slidable movement on said pivot plate a tool holder assembly including a first part pivotably mounted to said tool post for adjustable pivotal movement about a first horizontal axis, and a tool bit holding block mounted to said first part of said tool holder for pivotal movement about a second horizontal axis which is orthogonal to the vertical plane containing said first horizontal axis, said rectilinear guideway extending at an angle of forty-five degrees relative to said first and second horizontal axes, whereby pivotal movement of said pivot plate about said vertical axis causes a tool bit mounted to said tool bit holding block to orbit around said vertical axis.

2. A grinding fixture according to claim 1 wherein said first part comprises first and second legs lying in mutually orthogonal planes, said first leg being pivotally mounted to said tool post, and said second leg being pivotably mounted to said tool bit holding block.

3. A grinding fixture according to claim 2 wherein said second leg has convergent planar surfaces adjacent said tool post, the juncture of said surfaces contacting said tool post.

4. A grinding fixture according to claim 1 comprising a plurality of spaced stops fixed to said base plate and depending below the bottom surface of said base plate.

5. A grinding fixture according to claim 1 wherein said tool bit holding block is provided with a tool bit holding groove in the upper surface.

6. A grinding fixture according to claim 5 wherein said first part comprises first and second legs lying in mutually orthogonal planes, said first leg being pivotally mounted to said tool post, and said second leg being pivotably mounted to said tool bit holding block.

7. A grinding fixture according to claim 6 wherein said second leg has convergent planar surfaces adjacent said tool post, the juncture of said surfaces contacting said tool post.

8. A grinding fixture according to claim 6 wherein said second leg is provided with a reference mark on the top surface thereof, and a portion of said tool bit holding block disposed adjacent said second leg has a convex upper surface provided with a plurality of graduation lines.

9. A grinding fixture according to claim 6 wherein said rectilinear guideway extends at an angle of forty-five degrees relative to the vertical plane containing the principal longitudinal axis of said tool bit holding groove.

* * * * *